United States Patent [19]

Anno et al.

[11] Patent Number: 4,752,681

[45] Date of Patent: Jun. 21, 1988

[54] X-RAY IMAGE INTENSIFIER HAVING A CRYSTALLINE CONDUCTIVE FILM ON THE INPUT SCREEN

[75] Inventors: Hidero Anno, Tokyo; Katsuhiro Ono, Kawasaki; Norio Harao, Ayase, all of Japan

[73] Assignee: Kabushiki Kaisha Toshiba, Kawasaki, Japan

[21] Appl. No.: 33,775

[22] Filed: Apr. 3, 1987

[30] Foreign Application Priority Data

Apr. 4, 1986 [JP] Japan ..... 61-76461
Apr. 4, 1986 [JP] Japan ..... 61-76462

[51] Int. Cl.[4] ..... H01J 31/30
[52] U.S. Cl. ..... 250/213 VT; 250/486.1
[58] Field of Search ..... 313/525, 527, 530; 250/213 VT, 483.1, 486.1, 487, 488

[56] References Cited

U.S. PATENT DOCUMENTS

| | | | |
|---|---|---|---|
| 2,606,299 | 8/1952 | Coltman et al. | 313/66 |
| 3,838,273 | 9/1974 | Cusano | 250/213 VT |
| 3,868,512 | 2/1975 | Prener et al. | 250/483.1 |
| 4,002,938 | 1/1977 | Péhé | 313/527 |
| 4,100,445 | 7/1978 | Suffredini et al. | 313/527 |
| 4,209,705 | 6/1980 | Washida et al. | 250/486.1 |
| 4,398,118 | 8/1983 | Galves et al. | 250/213 R |
| 4,626,694 | 12/1986 | Sano et al. | 313/525 |

*Primary Examiner*—David C. Nelms
*Assistant Examiner*—Jessica Ruoff
*Attorney, Agent, or Firm*—Cushman, Darby & Cushman

[57] ABSTRACT

An X-ray image intensifier includes an input screen. The input screen has a base plate, a phosphor layer formed on the base plate, a transparent conductive film formed on the phosphor layer, and a photoemissive layer formed on the conductive film. The conductive film has a crystallinity wherein an average crystal size along a direction parallel to a surface of the conductive film is 500 Å or more.

10 Claims, 4 Drawing Sheets

X-RAY IMAGE INTENSIFIER HAVING A CRYSTALLINE CONDUCTIVE FILM ON THE INPUT SCREEN

BACKGROUND OF THE INVENTION

The present invention relates to an X-ray image intensifier.

A conventional X-ray image intensifier (to be referred to as an I.I. hereinafter) comprises a cylindrical glass envelope, an Al input window provided at one end of the glass envelope, and a cylindrical glass output envelope having a bottom and arranged at the other end of the glass envelope. An input screen is arranged in the glass envelope so as to face the input window, and an output screen is located on the bottom surface of the output envelope. A focusing electrode is attached to the inner surface of the glass envelope, and a conical accelerating electrode is provided near the output envelope.

X-rays emitted from an X-ray source are transmitted through an object and are incident on the input screen of the I.I. The input screen has a visual field having a diameter of, for example, 9 inches. A transmitted X-ray image of the object is converted into a photoelectron image by the input screen. The photoelectron image is focused and accelerated by the focusing electrode and accelerating electrode. Then, the image is incident on the output surface, and converted by the output screen into a fluoroscopic image having a diameter of, for example, 20 mm.

A conventional input screen has a structure wherein a phosphor layer having upper and lower deposited layers containing cesium iodide as a matrix is formed on an aluminum base plate. A vapor source is an activated particulate phosphor formed of cesium iodide containing sodium iodide. The lower deposited layer has a thickness of 180 μm upon deposition of the phosphor particles in an argon gas atmosphere at $1.3\times10^{-2}$ Pa or more. The upper deposited layer has a thickness of 30 m or less upon deposition of the phosphor particles on the lower deposited layer at a high vacuum of $1\times10^{-3}$ Pa or less. A transparent conductive film made of, for example, indium oxide is formed on the surface of the upper deposited film.

The input screen is built into an I.I. and baked at a vacuum. Thereafter, a photoemissive layer is formed on the input screen.

The photocurrent per unit dosage rate (to be referred to as input sensitivity hereinafter) of the image intensifier having the above construction was measured, while X-rays having 7 mm thickness of aluminium half value layer are radiated to the I.I. with being operated. As a result, the input sensitivity was found to be 4.0 nA/mR·min$^{-1}$. The critical resolution of the I.I. was measured by using a resolution chart formed of a 100-μm thick lead plate located at the center of the input window surface. The critical resolution was found to be 40 lp/cm.

In the above I.I., even when the X-ray dosage rate of an X-ray passed through the patient is about 20 μR/sec, an output image from the I.I. can be fluoroscopically observed by a TV camera. However, since the X-ray dosage rate is low, the number of X-ray quanta is subjected to spatial and temporal fluctuations. These fluctuations cause image noise which interferes with diagnostic examinations. In order to reduce the image noise, the X-ray dosage rate must be increased. As a result, the patient is exposed to an increased X-ray dose, to cause the problem of safety.

The present inventors performed the following two tests.

(TEST EXAMPLE 1)

In order to solve the above problem, to increase the thickness of the input phosphor layer of the image intensifier is a most effective way of obtaining a higher X-ray absorbance of the phosphor layer. Under the same manufacturing conditions as those of the above-mentioned phosphor layer, only the thickness of the phosphor layer was increased to within the range 300 to 500 μm. The photoemissive layer was manufactured under the same conditions as described above.

The input sensitivity and the critical resolution of the resultant I.I. were measured, and the present inventors found that input intensity could be improved by increasing the thickness of the phosphor layer. In addition, when the thickness of the CsI phosphor layer was 300 to 500 μm, the X-ray absorbance was increased, thereby reducing image noise as compared with the conventional image intensifier.

However, when the thickness of the phosphor layer was increased, the critical resolution deteriorated. This is because the scattering of luminescence in the phosphor layer increased as the thickness of the phosphor layer was increased.

(TEST EXAMPLE 2)

The present inventors carried out extensive studies as to a method of manufacturing an input phosphor layer wherein the critical resolution was 40 lp/cm, even when the thickness of the phosphor layer was about 500 μm. This objective was achieved by means of the following two processes:

(1) A change of a deposition condition of the lower deposited layer;

(2) Formation of a light-absorbing film on the surface of the base plate.

Item (1) was derived by studying the fabrication conditions described in Japanese Patent Disclosure (Kokai) No. 57-136744. Item (2) was derived from a method described in Japanese Patent Disclosure (Kokai) No. 56-165251. The resultant blackened film had a reflectance of 10% or less for the luminescent light of CsI/Na.

An example of an improved image intensifier was fabricated using processes (1) and/or (2), and the input sensitivity and the critical resolution thereof were measured. If the thickness of the CsI phosphor layer was as much as 200 μm in the conventional I.I., a very high resolution of 52 lp/cm could be obtained. When the thickness of the phosphor layer was increased, the resolution decreased. However, the same resolution (i.e., 40 lp/cm) as in the conventional I.I. could be maintained even at a thickness of 500 μm.

However, the input sensitivity decreases by about 38% as compared with the conventional I.I. Even if the thickness was 500 μm, which facilitated the highest input sensitivity within the tested thickness of the phosphor layer.

As is apparent from the above description, X-ray quantum noise can be reduced as the thickness of the phosphor screen is increased. In this case, however, the resolution or input sensitivity is degraded to fail to provide a practical I.I. The resolution has a contradictory relationship with the input sensitivity. When the thickness of the input phosphor layer is increased to 300 μm or more so as to reduce image noise, it is then impossible to set resolution and input sensitivity values which fall within the practical range.

SUMMARY OF THE INVENTION

The present invention has been developed in consideration of the above situation, and has as its object to provide an X-ray image intensifier having input sensitivity and resolution equal to or greater than the conventional image intensifier, even when the thickness of an input phosphor layer is increased to reduce image noise.

In order to achieve the above object an input screen of an image intensifier according to the present invention comprises a base plate, a phosphor layer formed on the base plate, a transparent conductive film formed on the phosphor layer, and a photoemissive layer formed on the conductive film. The transparent conductive film has crystallinity wherein an average crystal size along a direction parallel to the surface of the conductive film is 500 Å or more.

When the crystal size is 500 Å or more, the area of crystal grain boundaries in the transparent conductive film is reduced. Thus, metal elements constituting the photoemissive layer tend not to diffuse in the conductive film. Therefore, the sensitivity of the photoemissive layer and hence the I.I. can be improved. As the result, even when the thickness of the input phosphor screen is increased so as to improve an image noise characteristics of the I.I., sufficiently high input sensitivity and resolution can be obtained.

BRIEF DESCRIPTION OF THE DRAWINGS

FIGS. 1 to 8 show an X-ray image intensifier according to an embodiment of the present invention, in which:

FIG. 1 is a longitudinal sectional view of the I.I.;

FIG. 2 is an enlarged sectional view of an input screen of the I.I.;

FIG. 3 is a partial enlarged sectional view of a transparent conductive film in the I.I.;

FIG. 4 is a view showing changes in the crystal size and transmittance of the conductive film, depending on the $SnO_2$ content;

FIG. 5 is a view showing changes in the input sensitivity/transmittance and input sensitivity, depending on the $SnO_2$ content;

FIG. 6 is a view showing changes in the input sensitivity/transmittance, depending on the crystal sizes of the transparent conductive film;

FIG. 7 is a view showing changes in the sensitivity and resolution of the I.I., depending on the thickness of the phosphor layer; and FIG. 8 is a view showing changes in the S/N ratio, depending on the dosage rates of the I.I.

DETAILED DESCRIPTION OF THE PREFERRED EMBODIMENTS

An X-ray image intensifier according to an embodiment of the present invention will now be described in detail, with reference to the accompanying drawings.

Figure 1:
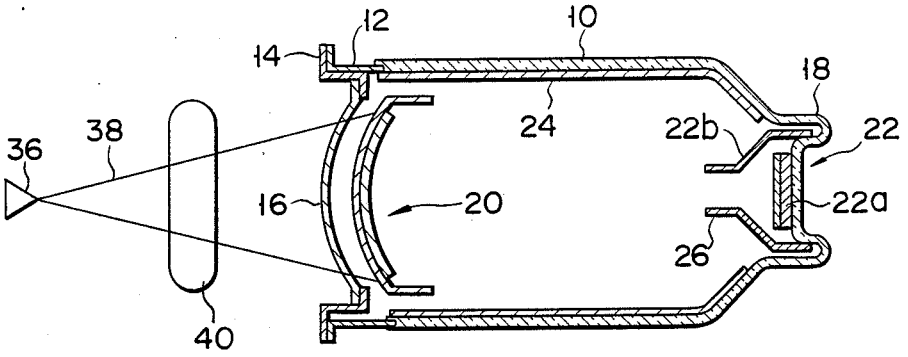

As is shown in FIG. 1, an X-ray image intensifier comprises cylindrical glass envelope 10, A1 input window 16 attached to one end of envelope 10 through cover ring 12 and stainless ring 14, and cylindrical glass output envelope 18 having a bottom and arranged at the other end of envelope 10. Output envelope 18 serves as an output window. Input screen 20 is arranged in envelope 10 to face input window 16. Output window 22 is provided at the bottom of envelope 18. Focusing electrode 24 is arranged on the inner surface of envelope 10. Conical accelerating electrode 26 is provided near envelope 18.

Figure 2:
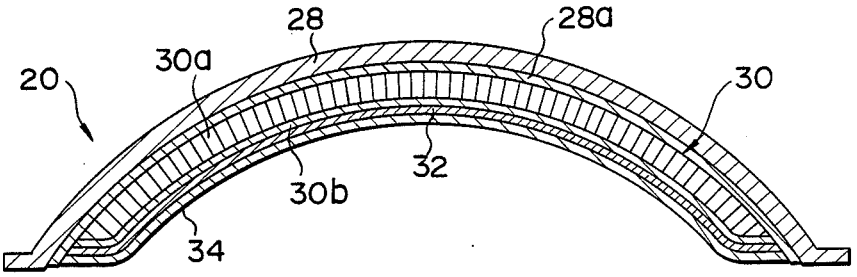

As is shown in FIG. 2, input screen 20 comprises aluminum base plate 28, phosphor layer 30 formed thereon, transparent conductive film 32 formed on phosphor layer 30, and photoemissive layer 34 formed on film 32. Output screen 22 comprises glass base plate **22*a* with phosphor layer 22*b* formed thereon, as is shown in FIG. 1**.

As is shown in FIGS. 1 and 2, X-rays 38 emitted from X-ray source 36 are transmitted through object 40, and are incident on the image intensifier, through window 16, so as to form an X-ray image on phosphor layer 30 of input screen 20. The X-ray image is converted into a luminescence image by phosphor layer 30. The luminescence image is converted into a photoelectron image by photoemissive layer 34. The photoelectron image is focused and accelerated by electrodes 24 and 26 on phosphor layer **22*b* of output screen 22. The photoelectron image is converted into a visible image, i.e., an output image, by phosphor layer 22*b***.

The structure of input screen 20 will now be described in detail, with reference to FIG. 2.

As is shown in FIG. 2, light-absorbing layer **28*a* is formed on the surface of aluminum base plate 28. Phosphor layer 30 is formed on light-absorbing layer 28*a*, under conventional deposition conditions. Layer 30 includes a two-layer structure consisting of lower deposited layer 30*a* and upper deposited layer 30*b*. Layer 30*a* is formed by depositing a phosphor, containing cesium iodide as a matrix and activated by sodium iodine, in an argon gas atmosphere at $1.3\times10^{-2}$ Pa or more. Layer 30*b* is deposited on layer 30*a* at a high vacuum of $1\times10^{-3}$ Pa or less, and has a thickness of 30 μm or less. The thickness of phosphor layer 30** is set to be 300 to 500 μm.

Transparent conductive film 32 formed on phosphor layer 30 is composed of indium-tin oxide and has a thickness of 5,000 Å or less. The transparent conductive film is formed in an oxygen atmosphere, according to an electron beam evaporation method. The vapor material is a tablet obtained by pressing a mixture of indium oxide ($In_2O_3$) powder and tin oxide ($SnO_2$). During formation of film 32, phosphor layer 30 is kept at 300° C. The average crystal size of conductive film 32, measured using a scanning electron microscope, was found to be 1,450 Å in the case of 5 mol % $SnO_2$ mixing ratio.

Figure 3:
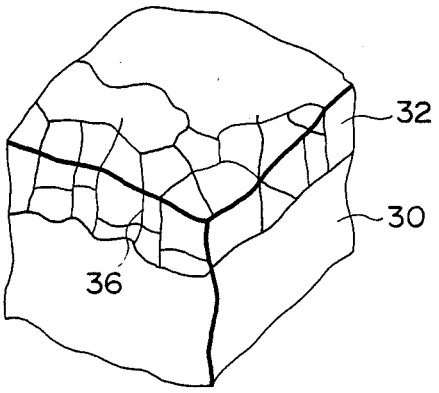

FIG. 3 schematically illustrates the crystallinity of transparent conductive film 32 formed of a tin-indium oxide deposited film. As is apparent from FIG. 3, the crystal size is found to be large and the area of crystal grain boundaries 36 is small. After input screen 20 is built into the I.I., photoemissive layer 34 is formed on transparent conductive film 32, according to a conventional method.

Figure 4:
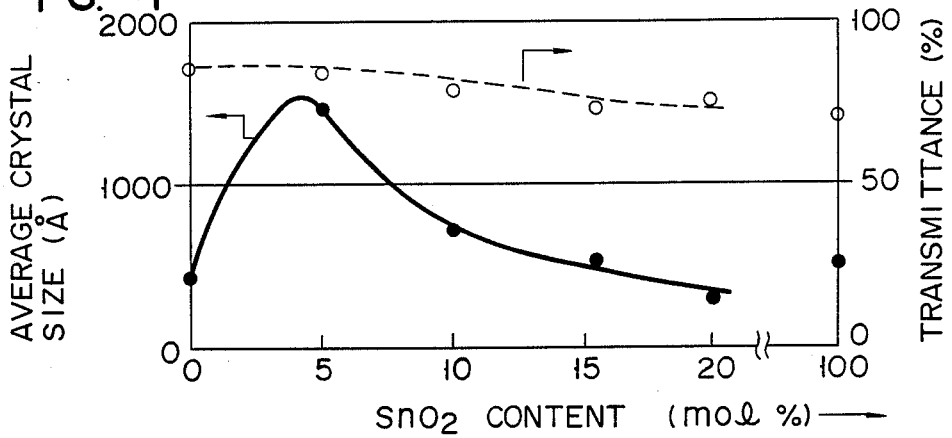

In this embodiment, five transparent conductive films 32 were formed having $SnO_2$ mixing ratios of 5 mol %, 10 mol %, 16 mol %, 20 mol %, and 100 mol %, respectively. The resultant conductive films were found to have sheet resistances of 100 kΩ or less. Average crystal sizes and transmittances for the luminescence from phosphor layer 30 of all conductive films were measured and summarized in FIG. 4. The average crystal size is defined such that the radii of inscribed circles of about 100 crystals are measured by observing an electron microscopic photograph, and an average value of these radii is calculated. The crystal size measured by this method is a size along a direction parallel to the surface of the conductive film. In FIG. 4, the abscissa shows the $SnO_2$ content in the conductive film, and the ordinates show the average crystal size and the transmittance, respectively. As is apparent from FIG. 4, when the $SnO_2$ content is increased, the transmittance is decreased if the film thickness is kept unchanged. The average crystal size shows maximum value of 1,500 Å at 5 mol %. When the $SnO_2$ content is 100%, the average crystal size is 510 Å.

Figure 5:
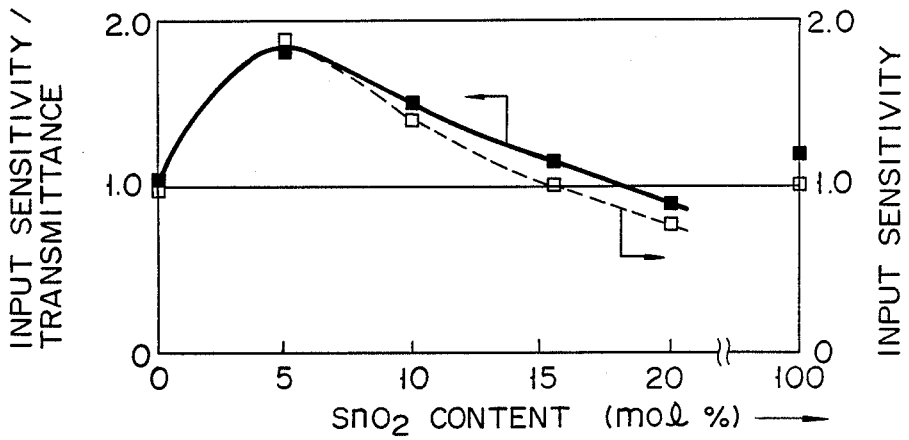

The photocurrent (input sensitivity) of the photoelectric screen was measured while X-rays were incident on the image intensifier incorporating I.I. having input screen 20. In FIG. 5, the ordinate shows the photocurrent/transmittance values which are normalized assuming that the value, when the $SnO_2$ content in conductive film 32 is zero as in the conventional case is set to be 1. As is apparent from FIG. 5, the sensitivity of photoemissive layer 34 is higher than the conventional case (the $SnO_2$ content is 0 mol %), except for the case wherein the $SnO_2$ content is 20 mol %.

Figure 6:
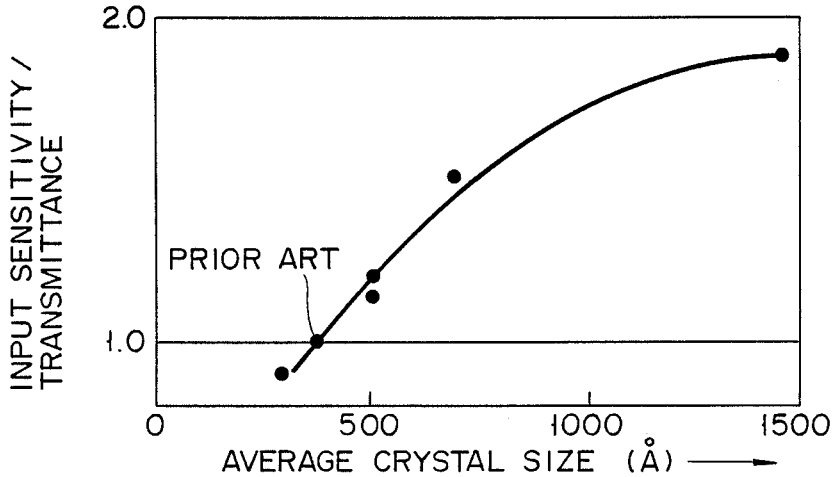

The values of photocurrent/transmittance are plotted as a function of the average particle size, as is shown in FIG. 6. From FIG. 6, it can be seen that the sensitivity of photoemissive layer 34 is increased according to the increase of the average crystal size.

As is described above, when the crystal size of transparent conductive film 32 is large, the area of crystal grain boundaries 36 is reduced, so that alkali metal elements constituting photoemissive layer 34 can be prevented from diffusing into the conductive film. Thus, a photoemissive layer having a high sensitivity can be obtained. In order to obtain a high input sensitivity, the average particle size of the transparent conductive film must be 500 Å or more. In this embodiment, the average crystal size is set within the range of 500 to 1,500 Å. However, in practical use, the average crystal size can be set within a range of 500 to 5,000 Å.

Figure 7:
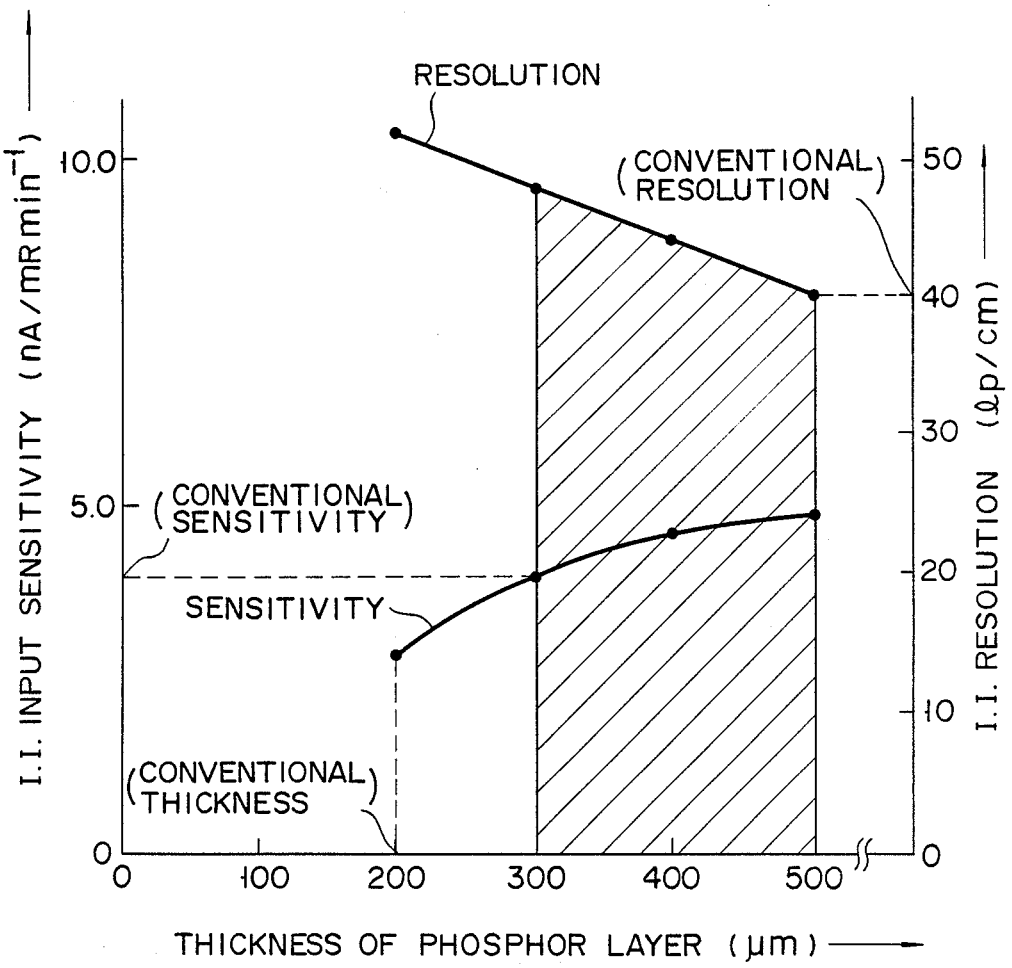

FIG. 7 shows results obtained from the measurement of input sensitivity and the critical resolution of the I.I. provided with input screen 20 including a transparent conductive film with an average crystal size of 1450Å. In FIG. 7, the abscissa indicates the thickness of phosphor layer 30, and the ordinates indicate the input sensitivity and the resolution, respectively.

As is apparent from FIG. 7, if the thickness of phosphor layer 30 falls within the range of 300 to 500 μm, the input sensitivity and the critical resolution of the I.I. are equal to or better than those of the conventional case. For example, if the thickness is 400 μm, the input sensitivity can be improved by +15% as compared with the conventional structure, and the critical resolution is also improved by +10%.

Figure 8:
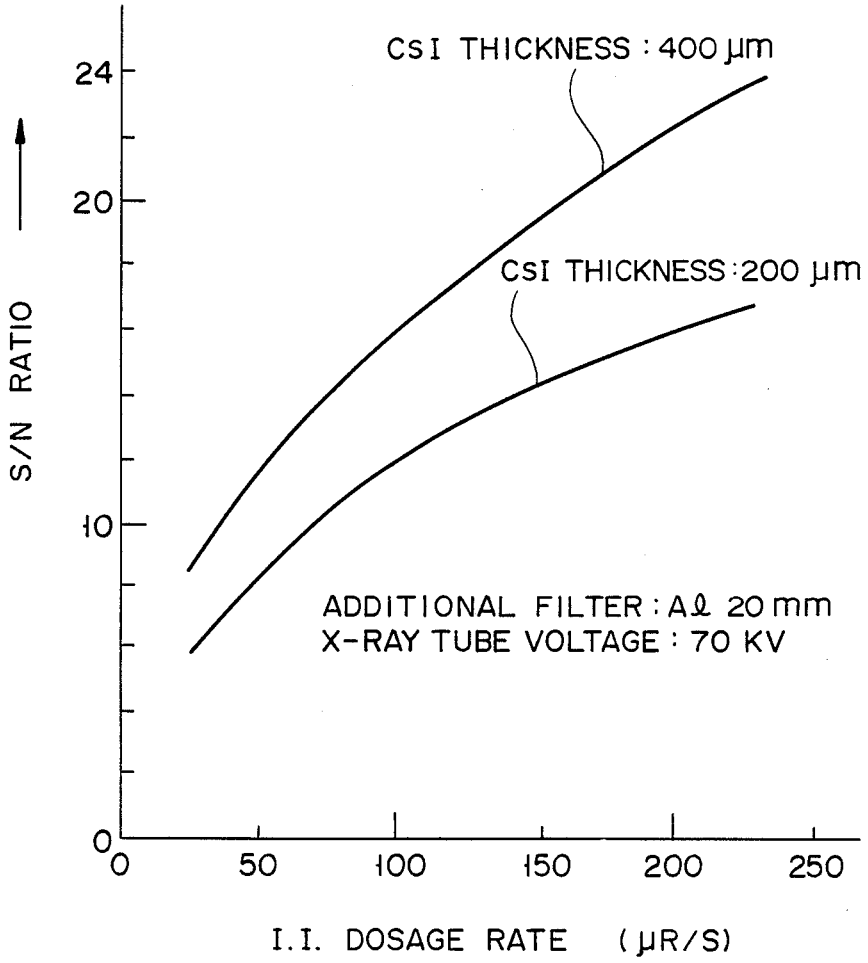

FIG. 8 shows results wherein image noise characteristics of the X-ray image intensifier using the input screen with a 400 μm thick phosphor layer are measured, and the measured values are compared with those of a conventional I.I. having the input screen with a 200 μm thick phosphor layer. Measurements were made by causing a photomultiplier to detect a light output from that portion of the output screen which corresponds to a central portion having a diameter of 1 mm on the input screen. As the noise component, an RMS value of the detected signal, which has passed through a 1 Hz–30 Hz band-pass filter, was measured.

It has been found that an S/N ratio is improved by 50 to 40% when the input dosage rate is in the range of 20 to 220 μR/sec. Therefore, an X-ray image intensifier can be provided wherein an X-ray quantum noise is greatly reduced. By using the improved I.I., a smaller object can be discriminated, at an identical X-ray dosage rate, as compared with the conventional I.I. In addition, a smaller difference in the X-ray transmittance can be identified, as compared with the conventional I.I. The input X-ray dosage rate of the improved I.I. can be smaller than that of the conventional one at an identical discrimination limit. Therefore, the dose of X-rays to which the patient is exposed can be reduced.

As is described above, since the crystal size of the transparent conductive film is increased to improve the sensitivity of the photoemissive layer, even if the resolution of the input screen is increased to the same level as or a higher level than that of the conventional I.I., it is possible to obtain such a device having a high input sensitivity. Therefore, the resolution can be improved without sacrificing the input sensitivity, and the amount of image noise can be reduced.

In order to improve the image noise characteristics, the thickness of the phosphor layer must be 300 μm or more. In this embodiment, the thickness is set within the range of 300 to 500 μm. However, in practical use, the thickness can be set within the range of 300 to 600 μm.

The present invention is not limited to the embodiment described above. Various changes and modifications may be made within the spirit and scope of the invention.

The material of the transparent conductive film is not limited to the one in the above embodiment. Other materials such as $In_2O_3$, $In_2O_3$:W, $In_2O_3$:Mo, $SnO_2$:Sb, $SnO_2$Cd, $TiO_2$, CuI, ZnO, ZnO:Cu, CdO, $ZrO_2$, and iridium oxide may be used. The method of forming the transparent conductive film can be selected from among evaporation, ion plating, sputtering, magnetron sputtering, ion beam sputtering, and plasma chemical-vapor-deposition.

In the above embodiment, the conductive film is formed directly on the surface of the phosphor layer. However, the same effect as in the above embodiment can be obtained even when an insulating protective film such as an aluminum oxide film or any other transparent conductive film is formed between the conductive film and the phosphor layer.

In the 300- to 600-μm thick phosphor layer containing cesium iodiode as a matrix, sodium is used as an activation agent. However, even when other activation agents are used together with sodium (e.g., sodium and lithium, or sodium and copper), or even when another activation agent (e.g., thallium) is used alone, it is possible to obtain an improvement of the input sensitivity due to the improved conductive film. Further, even when the upper deposited layer **30*b*** is formed of cesium iodiode containing no activation agent, the input sensitivity can be improved by means of the improved conductive film.

A technique for improving the resolution of the phosphor layer is exemplified in the case wherein the light-absorbing film is formed on the substrate surface.

It is possible to improve the resolution of the phosphor layer by using other techniques. As far as the deposited layer containing cesium iodide as a matrix is used as the phosphor layer, however, the same degradation of input sensitivity as in the above embodiment inevitably occurs. This is because the luminescence component causing degradation of the resolution also influences the input sensitivity. The method of depositing the 300 to 600 μm thick phosphor layer containing cesium iodide as a matrix is not limited to the one featured in the above embodiment.

What is claimed is:

1. An X-ray image intensifier comprising:

an input screen including a base plate, a phosphor layer formed on the base plate, a transparent conductive film formed on the phosphor layer, and a photoemissive layer formed on the conductive film, said transparent conductive film having a crystallinity wherein an average crystal size along a direction parallel to a surface of the conductive film is 500 Å or more.

2. An intensifier according to claim 1, wherein said transparent conductive film is formed on indium oxide or a metal oxide containing indium oxide as a major constituent.

3. An intensifier according to claim 2, wherein said transparent conductive film is formed of an indium oxide containing tin.

4. An intensifier according to claim 1, wherein said transparent conductive film is formed of a tin oxide or a metal oxide containing tin oxide as a major constituent.

5. An intensifier according to claim 1, wherein said phosphor layer is formed of a phosphor containing an alkali halide as a matrix.

6. An intensifier according to claim 1, wherein said phosphor layer is formed of a phosphor containing cesium iodide as a matrix.

7. An intensifier according to claim 1, wherein said average crystal size falls within a range of 500 to 5,000 Å.

8. An intensifier according to claim 7, wherein said average crystal size falls within a range of 500 to 1,500 Å.

9. An X-ray image intensifier comprising:

an input screen including a base plate, a phosphor layer formed on the base plate and containing a cesium iodide as a matrix, the phosphor layer having a central portion whose thickness falls within a range of 300 to 600 μm, a transparent conductive film formed on the phosphor layer, and a photoemissive layer formed on the conductive film, the transparent conductive film having a crystallinity wherein an average crystal size along a direction parallel to a surface of the conductive film is 500 Å or more.

10. An intensifier according to claim 9, wherein said input screen includes a light-absorbing film formed between the base plate and the phosphor layer, for absorbing light from the phosphor layer.

* * * * *